United States Patent [19]

Braud

[11] Patent Number: 4,860,946

[45] Date of Patent: Aug. 29, 1989

[54] INVOICE FORM WITH CARD AND ENVELOPE

[75] Inventor: Harry A. Braud, Bossier City, La.

[73] Assignee: Moore Business Forms, Inc., Grand Island, N.Y.

[21] Appl. No.: 213,279

[22] Filed: Jun. 29, 1988

[51] Int. Cl.[4] ..... B65D 27/10

[52] U.S. Cl. ..... 229/69; 229/70; 282/11.5 A

[58] Field of Search ..... 229/69, 70; 282/25, 282/11.5 A

[56] References Cited

U.S. PATENT DOCUMENTS

| | | | |
|---|---|---|---|
| 2,374,275 | 4/1945 | Ertola | 282/DIG. 1 |
| 3,507,519 | 4/1970 | McNabb | 229/69 |
| 3,726,471 | 4/1973 | Kalb | 229/70 |
| 3,833,167 | 9/1974 | Kapitan | 229/69 |
| 3,952,942 | 4/1976 | O'Leary et al. | 229/69 |
| 4,055,294 | 10/1977 | Traise | 229/69 |
| 4,706,877 | 11/1987 | Jenkins | 229/69 |
| 4,756,468 | 7/1988 | Jenkins | 229/69 |

*Primary Examiner*—Stephen P. Garbe
*Attorney, Agent, or Firm*—Nixon & Vanderhye

[57] ABSTRACT

The multi-ply business form set includes first and second plies having first and second sections separable along a transversely extending line of perforations. The first section has information blocks to comprise an original invoice and a file copy. The second section is divided into two parts, separable each from the other and from the first section. The first part has a card portion which extends transversely a distance less than the width of the form set. The second part includes an envelope formed by gluing the first and second plies one to the other along the margins defining the envelope. The envelope portion extends transversely a distance greater than the card portion but less than the width of the form set. Upon separation of the two parts from the first section and from each other and discarding the stubs of the remaining parts, the card may be disposed in the envelope, for example, for use as a card accompanying a delivery of flowers.

20 Claims, 3 Drawing Sheets

INVOICE FORM WITH CARD AND ENVELOPE

BACKGROUND OF THE INVENTION

The present invention generally relates to a continuous business form web separable into discrete business form sets and particularly relates to a continuous business form web wherein each discrete form set serves as an invoice with a separable card and envelope.

Multi-ply, carbonless, continuous business form webs for use in printers are generally well known. In many such continuous business form webs, the plies of the carbonless form sets are mechanically secured one to the other along their opposite margins. Also, a plurality of longitudinally spaced tractor holes are provided along these outer margins. The margins thus typically comprise feed strips and are generally separable from the form sets along longitudinally extending lines of perforations prior to use.

The uses for such form sets are many and varied. In one such prior carbonless two-ply business form set, the plies of a first section of the form set included an invoice and a file copy, respectively. A second section of the form was detachable from the first section for use as a note or card. In that combined invoice and card form set, the lower section of the form included two parts, one on which a note could be written, and another with an address block for appearing through the window of a standard envelope. For example, in the distribution of flowers, customer identifying information would be written on the invoice section of the form and the name and address of the individual or entity to receive the flowers would similarly be written on the invoice. The invoice would be forwarded or given to the customer and the file copy kept. One part of the lower section of the form set served as a note or card area, the other part served as an address area. The customer would pen the note and the address of the individual to receive the flowers on that lower section. The lower section of the form set would then be disposed in a standard window envelope with the address showing through the window for delivery with the flowers. This, however, constituted a rather large and bulky card system having little aesthetic appeal and generally does not function well as a delivery card for flowers.

In accordance with the present invention, the deficiencies of the foregoing described business form sets having the combined invoice and card have been remedied in a novel and unique manner. Particularly, the present invention provides, as part of a continuous business form web, a discrete multi-ply, preferably carbonless, form set with integral card and forwarding envelope. The form set is divided into first and second sections which may comprise top and bottom sections. The sections are separable one from the other along a transversely extending perforation line. Preferably, the top section is an invoice section which contains prerecorded information as well as space for recording information specific to a particular customer. For example, such information might comprise identifying data for the business concern selling flowers, identifying information pertaining to the customer who wishes to send flowers, information relating to the quantity, type and price of the flowers requested to be delivered, and, finally, information concerning the identity and address of the individual to receive the flowers. Such information may be arranged, as desired, on the invoice section and most, if not all, would be provided on both plies.

The second section of the form is comprised of two parts. A first part includes a card or note portion which has a transverse extent less than i.e., about half of, the transverse extent of the form set. The remaining portion of the first part of this section constitutes a stub, both plies of which may be removed from the form set when used and discarded. More particularly, the first part of the second section is joined to the first section of the form set along the transversely extending line of perforations separating the sections and is also secured to the second part of the second section along a transversely extending line of perforations. The card or note portion is separable from the stub along a longitudinally extending line of perforations intermediate the edges of the form set, i.e., approximately in the middle of the form set. Consequently, by tearing along both transverse and longitudinally extending perforation lines, the card or note portion of one or both of the plies may be removed from the form set. Because the card or note portion is foreshortened in the transverse direction, it is dimensioned similarly as cards conventionally employed, for example, when delivering flowers but which conventional cards do not comprise part of a business form set. Consequently, the card or note portion of this business form set has the look and dimensions of the aesthetically pleasing conventional card.

The second part of the second section provides an envelope for receiving the card. More particularly, the second part is joined to the first part along the transversely extending line of perforations and extends transversely a distance greater than the transverse extent of the card but short of the entire width of the form set. Thus, a stub completes the transverse extent of the second part, both plies of the stub being separable from the envelope along a longitudinally, extending line of perforations. Heat sealable or cold pocket paste adhesive is provided along three margins of the envelope inset from the above-described lines of perforation and between the plies, thereby securing the first and second plies one to the other to define the envelope. Consequently, upon removal of the second part from the form set and removal of the stub from the second part, there is provided an envelope sealed along three of its margins and open along its fourth side. The envelope is also of a size for receiving the card of the first part of the second section of the form set without folding the card. Consequently, when the customer fills in the card and writes the identity and address of the recipient of the flowers, the second section may be removed from the first section of the form set and disassembled to provide a discrete card and envelope. The card may then be disposed within the envelope. The envelope is not provided with a flap because it may be attached to a plastic clip provided as part of the floral arrangement as is conventional.

As with the invoice, it will be appreciated that both the card and the envelope may have prerecorded information on their faces. Such information might include the identity of the florist supplying and delivering the flowers. Additionally, because the form set comprises multi-plies, the first ply of the invoice may be forwarded to the customer and the second ply retained as a file copy, with all of the pertinent information recorded thereon.

While the card and envelope portions are preferably longitudinally spaced one from the other along the form set and preferably also configured and oriented such that they are both rectangular with their lengthwise directions extending transversely of the form set, it will be appreciated that one or both of the card and envelope portions may be otherwise oriented and situated in the form set. For example, these portions may be located side-by-side in the form set or disposed on their sides in the form set. Further, because it is preferable to provide an envelope portion slightly larger, i.e., longer, than the card portion to avoid the necessity of folding the card and also necessary to provide an envelope portion having a depth greater than the depth of the card portion, there will remain stub portions in the form set which may be discarded. As will be appreciated, the form sets are generally rectangular in plan. To facilitate manufacturing the form set with differently sized card and envelope portions, the stub portion therefore completes the remainder of the form set necessary to render it rectangular in plan. The stub portion may be one or two parts, i.e., two rectangular portions as illustrated herein, or may be one part having the shape necessary to complete the remainder of the form set necessary to render it rectangular in plan, e.g., an L-shape.

In accordance with a particular embodiment of the present invention, there is provided a multi-ply business form set, comprising elongated first and second plies having first and second sections spaced longitudinally one from the other. A first line of perforations extends transversely of the form set whereby the sections are separable one from the other. The first section has invoice information recorded thereon whereby the first ply of the first section may be forwarded for payment and the second ply thereof retained for record keeping purposes. The second section includes a first part separable from the form set and having a portion in the form of a card having a transverse extent less than the transverse extent of the form set and a remaining transversely adjacent stub portion separable from the card portion along a longitudinally extending line of perforations in the first part intermediate the lateral edges of the form set such that the card and stub portions extend the full transverse extent of the form set. The second section also has a second part separable from the form set including an envelope portion defined by portions of the first and second plies, the envelope portion having a transverse extent less than the transverse extent of the form set and greater than the transverse extent of the card portion, the second part also having a stub portion transversely adjacent the envelope portion and separable therefrom along a longitudinally extending line of perforations in the second part intermediate the lateral edges of the form set such that the envelope and stub portions of the second part extend the full transverse extent of the form set. The envelope portion is formed by adhesive strips about the margins of the first and second ply portions defining the envelope portion and securing the first and second ply portions one to the other along the margins, with an opening to the envelope provided along corresponding registering edges of the first and second ply portions for receiving the card.

Accordingly, it is a primary object of the present invention to provide a novel and improved continuous business form web comprised of a plurality of discrete carbonless multi-ply form sets, each of which is divided into an invoice section and a section containing a card and envelope therefor of a size which is appropriate and aesthetic, for example, for use as the card and envelope in a flower supply and delivery service.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
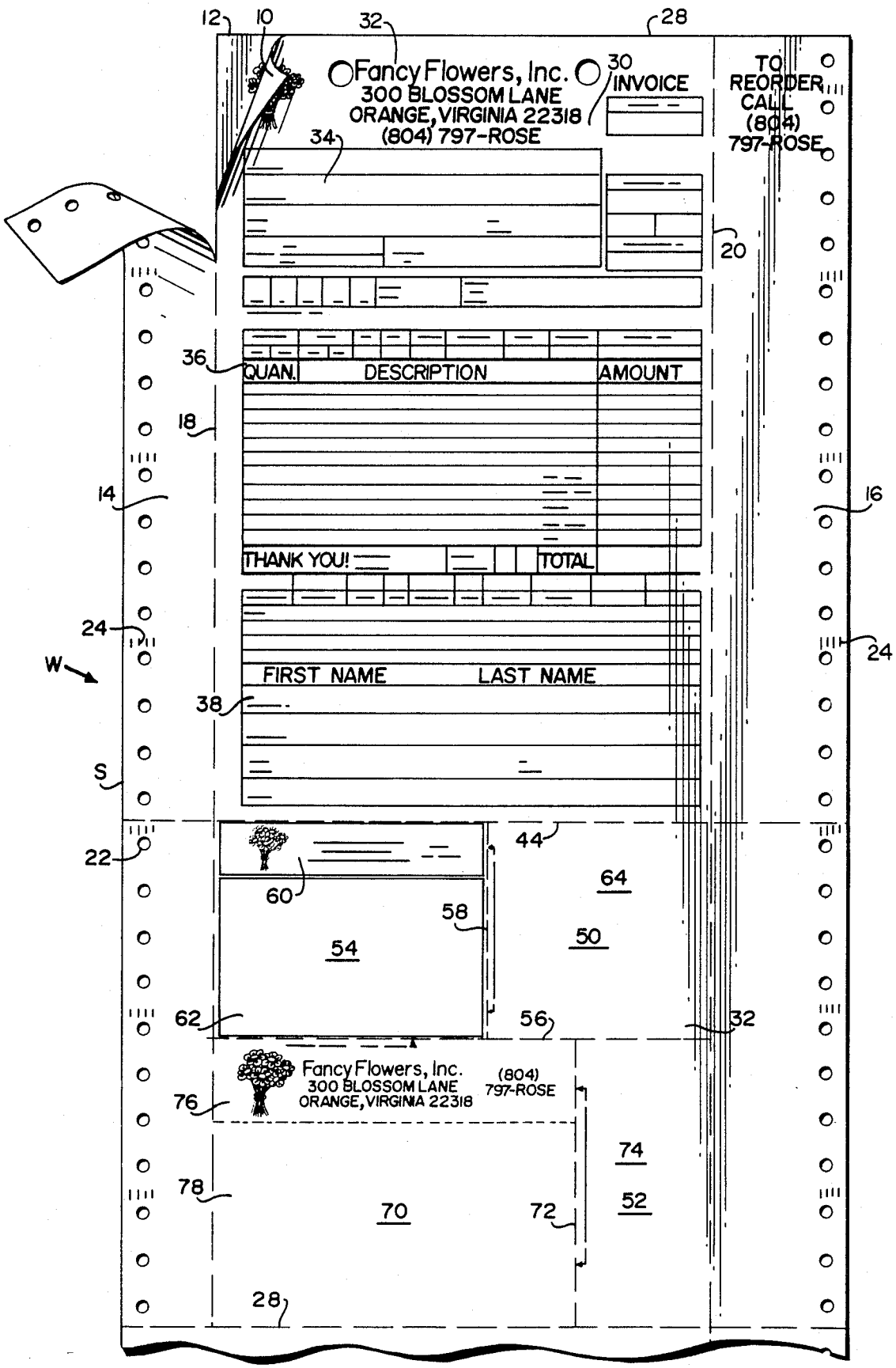
FIG. 1 is a plan view of a continuous business form web illustrating the front side of a multi-ply carbonless business form set forming part of the web.
Figure 2:
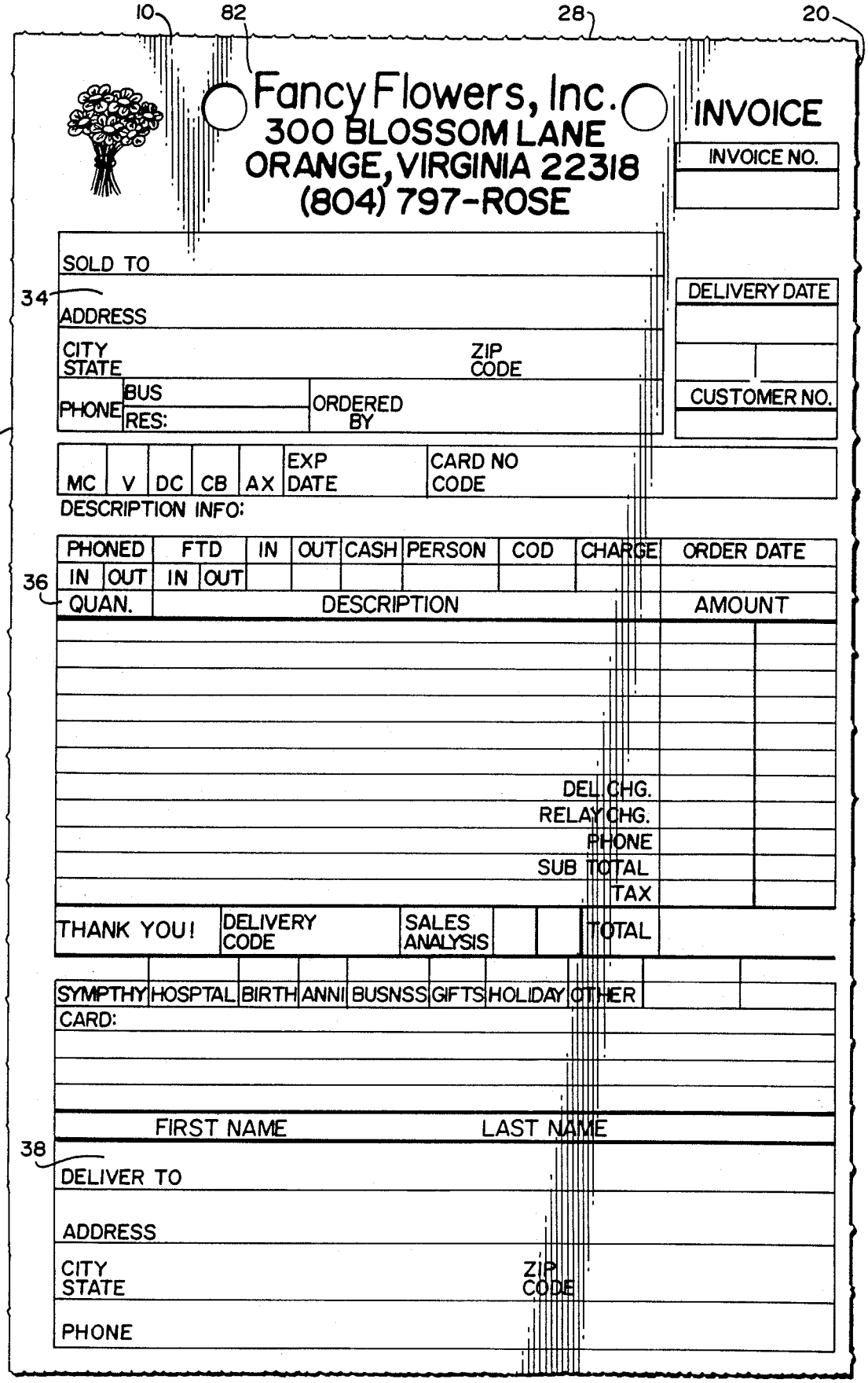
FIG. 2 is an enlarged plan view of the form set illustrated in FIG. 1 illustrating the invoice or first section thereof.

Referring now to the drawings, particularly to FIG. 1, there is illustrated a continuous business form web, generally designated W, and which web is comprised of a plurality of business form sets S. The continuous web W constitutes a multi-ply web, in this instance, two plies 10 and 12 and, consequently, each business form S comprises a multi-ply form set. The form sets are also carbonless. That is, the back face of the top ply 10 is coated with carbonless microcapsules, while the opposing face of the underlying ply 12 has a resin coating whereby information recorded on the first ply 10 is simultaneously recorded on the second ply 12. Reference is made to U.S. Pat. No. 4,199,174 of common assignee herewith for detailed information concerning carbonless form sets, the disclosure of which patent is incorporated herein by reference.

As is conventional, the continuous web W, and hence each form set S, are provided with marginal feed strips 14 and 16 along opposite edges separable from the body of the form set by longitudinally extending lines of perforations 18 and 20, respectively. Each marginal feed strip 14 and 16 has a plurality of tractor openings or holes 22 longitudinally spaced one from the other such that the continuous web W may be fed through printers with tractor sprockets engaging the openings 22 to advance the web. The multi-ply web and form sets are secured one to the other by mechanical crimps 24 spaced longitudinally one from the other along the marginal feed strips 14 and 16, respectively. It will be appreciated that each form set in the web is separable from adjoining form sets by transversely extending lines of perforations 28 at opposite ends of the form set. As set forth herein, all lines of perforations are provided in each of the first and second plies 10 and 12, respectively.

Each form set S is divided into first and second sections 30 and 32, respectively. In the presently preferred embodiment of the present invention, the first section 30 may have preprinted information, for example, such information may be provided at the top of the form at 32 to identify the florist supplying and delivering the flowers. Additionally, an information block 34 may be provided so that the customer and customer address may be recorded on the form at specified locations. A second information block 36 may be preprinted such that, for example, the quantity, description and price of the flowers to be delivered may be described. Other general information may be included in this block 36, for example, the nature of the event prompting the order for the flowers, i.e., birthday, anniversary, and the like. At the bottom of the first or invoice section 30, there is provided a further information block 38. Block 38 may identify the individual to receive the flowers and that individual's address and phone number. Consequently, all customer, delivery and billing information may be provided on the first or invoice portion section 30 of the form set. It will be appreciated, that because the form set S is carbonless, such preprinted information, as well as the information recorded on the form by the florist, will appear on the second ply 12. It will also be appreciated that the invoice section 30 is separable from the lower section 32 by a transversely extending line of perforations 44. Consequently, the first ply 10 of the invoice section may be forwarded to the customer, while the second ply 12 of the invoice section with like or identical information may be retained by the florist for record keeping purposes.

Figure 3:
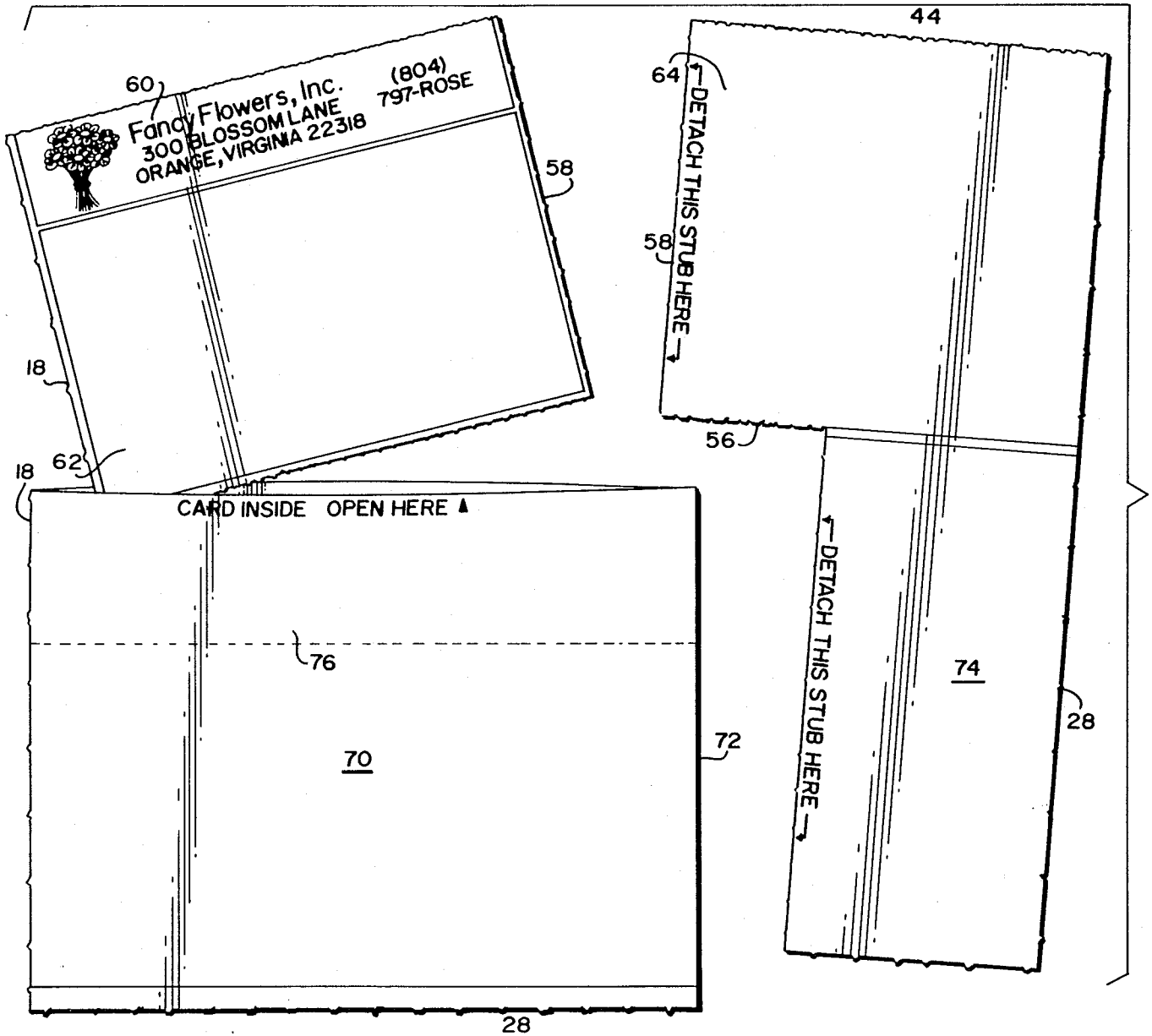
FIG. 3 is an enlarged plan view of the lower or second section of the form set with each portion thereof segregated along perforation lines and illustrating the card partially inserted into the envelope.

The second section 32 is preferably divided into first and second parts 50 and 52. The first part 50 is subdivided into a card or note portion 54 and a stub 64. The note portion may, for example, be confined within the transverse line of perforations 44, one of the longitudinally extending lines of perforations along one side of the form separating the form from the feed strip, for example, perforation line 18, and a second transversely extending line of perforations 56 also separating the first and second parts 50 and 52 of the second section 32 one from the other. Because the card 54 is dimensioned to correspond in size to conventional cards used for this purpose, i.e., cards used as delivery cards for delivering flowers, card 54 is further defined by a longitudinally extending line of perforations 58 provided generally centrally along the form set S between lines of perforations 44 and 56. Thus, upon separation of the first part 32 from the first section 30 along perforation line 44 and from the second part 52 along perforation line 56 and further separation of card 54 along perforation lines 58 and 18, there is provided a card of suitable size and aesthetic appeal. As illustrated in FIGS. 1 and 3, the card 54 may have an information identifying block 60 along its upper face. That information block, for example, may identify the florist supplying and delivering the flowers. A substantial space 62 is left on the card 54 on which the customer may write a note to the recipient. Consequently, by separating the card along the various perforation lines as described, the card comprised of the first ply 10 may be separated from the form for insertion in the envelope also forming part of the form, as will be described. It will be appreciated from a review of drawing FIGS. 1 and 3 that the card 54 extends transversely less than the full transverse extent of the form set, i.e., approximately half the transverse extent of the first part 50. The remaining stub 64 may be discarded when the card is separated from the set, together with the underlying ply portion of that section.

The lowermost or second part of the first section 32 comprises an envelope 70. Particularly, the second part 52 of the second section 32 may be removed from the first part thereof along perforation line 56. A longitudinally extending line of perforations 72 extends between the perforation line 56 and the perforation line 28 separating the form set S from an adjoining form set. As illustrated in FIGS. 1 and 3, the transverse extent of envelope 70, as defined by the longitudinal perforation lines 18 and 72 is greater than the transverse extent of card 54. Lines of perforation 72, however, are inset from the longitudinal perforation line 20 to leave a stub 74. To form the envelope, three of the four margins of the plies 10 and 12 defining envelope 70 are adhesively secured one to the other. For example, inset from each of the longitudinally extending lines of perforation 72 and 18 and inset from the transversely extending line of perforations 28 are marginal strips of adhesive. The adhesive strips are disposed between the plies, i.e., disposed on one of the plies, to secure the marginal portions of the first and second plies 10 and 12 which define envelope 70 one to the other. The plies remain separated one from the other along the line of perforation 56 to define an opening for the envelope 70. Consequently, the envelope 70 may be separated from the second section 32 by tearing along the perforation lines 18, 56, 72 and 28, the stub 74 being discarded. The face of the envelope portion on the first ply 10 may also have an information block 76, for identifying the florist supplying and delivering the flowers. An additional information block 78 may also be provided wherein information identifying the name and address of the recipient of the flowers may be disposed.

Consequently, in accordance with the present invention, there is provided in a continuous form web a plurality of discrete, multi-ply carbonless form sets, each having a preprinted invoice section for recording information, for example, concerning the identity and address of the customer, billing particulars, and the identity and address of the recipient and a second section which may be separable from the first section and into parts defining a card and envelope. Information blocks are provided on both the card and envelope to identify the recipient and the card may be inserted into the envelope as illustrated in FIG. 3 and clipped, by means not shown, to the floral arrangement. It will be appreciated that the dimension of the card and envelope is such that they are aesthetic and generally conform to the size and configuration of cards and envelopes conventionally provided when delivering floral arrangements but which are not part of a continuous business form web or a form set.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A multi-ply carbonless business form set, comprising:

elongated first and second plies having first and second sections longitudinally adjacent one another;

a first line of perforations extending transversely of said form set whereby the sections are separable one from the other;

said first section having invoice information recorded thereon, means for reproducing the invoice information on said first section of said first ply on said first section of said second ply whereby the first section of the first ply may be forwarded for payment and the first section of the second ply retained for record keeping purposes;

said second section including a first part separable from said form set and having a portion in the form of a card having a transverse extent less than the transverse extent of said form set and a remaining transversely adjacent stub portion separable from said card portion along a longitudinally extending line of perforations in said first part intermediate the lateral edges of the form set such that said card and stub portions extend the full transverse extent of said form set; and said second section having a second part separable from said form set and including an envelope portion defined by portions of said first and second plies, said envelope portion having a transverse extent less than the transverse extent of said form set and greater than the transverse extent of said card portion, said second part also having a stub portion transversely adjacent said envelope portion and separable therefrom along a longitudinally extending line of perforations in said second part intermediate the lateral edges of said form set such that said envelope and stub portions of said second part extend the full transverse extent of said form set, said envelope portion being formed by adhesive strips about the margins of said first and second ply portions defining said envelope portion and securing said first and second ply portions one to the other along said margins, with an opening to the envelope provided along corresponding registering edges of said first and second ply portions for receiving the card.

2. A form set according to claim 1 which comprises a portion of a continuous business web having a plurality of said form sets and lines of transversely extending perforations separating the form sets one from the other in the web, an elongated margin along at least one edge of said continuous business form web and having a plurality of openings therethrough longitudinally spaced one from the other and a longitudinally extending line of perforations separating said margin from said discrete form sets and means for connecting said first and second plies of said form sets one to the other at least along the margins of said continuous form web.

3. A form set according to claim 1 wherein the longitudinal extent of said envelope portion is greater than the longitudinal extent of said card portion.

4. A form set according to claim 1 wherein said first part is connected to said first section by said first transversely extending line of perforations and said second part is connected to said first part by a transversely extending line of perforations.

5. A form set according to claim 4 including a longitudinally extending margin along a lateral edge of said form set separable therefrom by a longitudinally extending line of perforations, said card portion being defined by said marginal longitudinally extending line of perforations, the longitudinal extending line of perforations in said first part, and said first and second transversely extending lines of perforations.

6. A form set according to claim 4 including a longitudinally extending margin along a lateral edge of said form set separable therefrom by a longitudinally extending line of perforations, said envelope portion being defined by said marginal longitudinally extending line of perforations, the longitudinal extending line of perforations in said second part, said second transversely extending line of perforations, and an edge of said second part defining the distal end edge of said form set.

7. A form set according to claim 5 including a longitudinally extending margin along a lateral edge of said form set separable therefrom by a longitudinally extending line of perforations, said envelope portion being defined by said marginal longitudinally extending line of perforations, the longitudinal extending line of perforations in said second part, said second transversely extending line of perforations, and an edge of said second part defining the distal end edge of said form set, said envelope opening being defined between said first and second plies along said second transversely extending line of perforations.

8. A form set according to claim 4 including a longitudinally extending margin along a lateral edge of said form set separable therefrom by a longitudinally extending line of perforations, said card portion being defined by said marginal longitudinally extending line of perforations, the longitudinal extending line of perforations in said first part, and said first and second transversely extending lines of perforations, and further including a second laterally extending margin along the opposite lateral edge of said form set separable therefrom by a longitudinally extending line of perforations, said stub portion in said first part being defined by said second marginal longitudinally extending line of perforations, the longitudinally extending line of perforations in said first part, and said first and second transversely extending lines of perforation.

9. A form set according to claim 4 including a longitudinally extending margin along a lateral edge of said form set separable therefrom by a longitudinally extending line of perforations, said envelope portion being defined by said marginal longitudinally extending line of perforations, the longitudinally extending line of perforations in said second part, said second transversely extending line of perforations, and an edge of said second part defining the distal end edge of said form set, and further including a second laterally extending margin along the opposite lateral edge of said form set separable therefrom by a longitudinally extending line of perforations, said stub portion in said second part being defined by said second marginal longitudinally extending line of perforations, the longitudinally extending line of perforations in said second part, said second transversely extending line of perforations and the distal end edge of said second part defining the distal end edge of said form set.

10. A multi-ply carbonless business form set, comprising:

elongated first and second plies having first and second sections longitudinally adjacent one another;

a first line of perforations extending transversely of said form set whereby the sections are separable one from the other;

said first section having invoice information recorded thereon, means for reproducing the invoice information on said first section of said first ply on said first section of said second ply whereby the first section of the first ply may be forwarded for payment and the first section of the second ply retained for record keeping purposes;

said second section including a first part separable from said form set and having a portion in the form of a card having a transverse extent less than the transverse extent of said form set; and said second section having a second part separable from said form set and including an envelope portion defined by portions of said first and second plies, said envelope portion having a transverse extent less than the transverse extent of said form set, said envelope portion being formed by adhesive strips about the margins of said first and second ply portions defining said envelope portion and securing said first and second ply portions one to the other along said margins, with an opening to the envelope provided along corresponding registering edges of said first and second ply portions for receiving the card.

11. A form set according to claim 10 wherein said envelope portion has a width greater than the width of said card portion for receiving the card portion with said envelope portion without folding.

12. A form set according to claim 11 wherein said second section has at least one stub portion, said sheets being rectangular in plan with said stub portion located to fill in the remainder of the form set necessary to render said sheets rectangular in plan.

13. A form set according to claim 12 wherein said one stub portion is longitudinally adjacent one of said card and envelope portions.

14. A form set according to claim 12 wherein said one stub portion is transversely adjacent one of said card and envelope portions.

15. A form set according to claim 10 which comprises a portion of a continuous business web having a plurality of said form sets and lines of transversely extending perforations separating the form sets one from the other in the web, an elongated margin along at least one edge of said continuous business form web and having a plurality of openings therethrough longitudinally spaced one from the other and a longitudinally extending line of perforations separating said margin from said discrete form sets and means for connecting said first and second plies of said form sets one to the other at least along the margins of said continuous form web.

16. A form set according to claim 12 wherein said one stub portion is longitudinally adjacent one of said card and envelope portions and transversely adjacent the other of said card and envelope portions.

17. A form set according to claim 12 wherein said card and envelope portions are rectangular in plan and are disposed in said form set with their long directions extending transversely of the form set.

18. A form set according to claim 17 wherein said one stub portion is longitudinally adjacent one of said card and envelope portions and transversely adjacent the other of said card and envelope portions.

19. A multi-ply carbonless business form set, comprising:

elongated first and second plies having first and second sections longitudinally adjacent one another;

a first line of perforations extending transversely of said form set whereby the sections are separable one from the other;

said first section having invoice information recorded thereon, means for reproducing the invoice information on said first section of said first ply on said first section of said second ply whereby the first section of the first ply may be forwarded for payment and the first section of the second ply retained for record keeping purposes;

said second section including a first part separable from said form set and having a portion in the form of a card having a transverse extent less than the transverse extent of said form set; and said second section having a second part separable from said form set and including an envelope portion defined by portions of said first and second plies, said envelope portion having a transverse extent less than the transverse extent of said form set;

said second section also having a stub portion separable therefrom;

said envelope portion being formed by adhesive strips about the margins of said first and second ply portions defining said envelope portion and securing said first and second ply portions one to the other along said margins, with an opening to the envelope provided along corresponding registering edges of said first and second ply portions for receiving the card; and said envelope portion having a width greater than the width of said card portion and said sheets being rectangular in plan with said stub portion configured and arranged in the form set to complete the remainder of the form set necessary to render said sheets rectangular in plan.

20. A form set according to claim 19 wherein said one stub portion is longitudinally adjacent one of said card and envelope portions and transversely adjacent the other of said card and envelope portions.

* * * * *